US005518853A

United States Patent [19]

Nguyen et al.

[11] Patent Number: 5,518,853

[45] Date of Patent: May 21, 1996

[54] DIFFUSION COATING PROCESS OF MAKING INVERSE COMPOSITE DUAL-LAYER ORGANIC PHOTOCONDUCTOR

[75] Inventors: Khe C. Nguyen, Los Altos; Sivapackia Ganapathiappan, Mountain View; Tan Ha, Milpitas, all of Calif.

[73] Assignee: Hewlett-Packard Company, Palo Alto, Calif.

[21] Appl. No.: 466,001

[22] Filed: Jun. 6, 1995

Related U.S. Application Data

[62] Division of Ser. No. 287,437, Aug. 8, 1994.

[51] Int. Cl.[6] ..... G03G 5/047

[52] U.S. Cl. ..... 430/132

[58] Field of Search ..... 430/58, 59, 132

[56] References Cited

U.S. PATENT DOCUMENTS

| | | | |
|---|---|---|---|
| 4,409,309 | 10/1983 | Oka | 430/65 |
| 4,444,862 | 4/1984 | Yagi et al. | 430/67 |
| 4,578,334 | 3/1986 | Borsenberger et al. | 430/59 |
| 4,701,396 | 10/1987 | Hung et al. | 430/58 |
| 4,835,079 | 5/1989 | Fujimura et al. | 430/58 |
| 4,882,253 | 11/1989 | Kato et al. | 430/59 |
| 4,927,727 | 5/1990 | Rimai et al. | 430/99 |
| 4,948,687 | 8/1990 | Murase et al. | 430/58 |
| 4,968,578 | 11/1990 | Light et al. | 430/126 |
| 4,968,579 | 11/1990 | Kimoto et al. | 430/134 |
| 5,037,718 | 8/1991 | Light et al. | 430/126 |
| 5,102,759 | 4/1992 | Fuse et al. | 430/59 |
| 5,162,184 | 11/1992 | Aizawa | 430/59 |
| 5,213,927 | 5/1993 | Kan et al. | 430/59 |
| 5,240,802 | 8/1993 | Molaire et al. | 430/67 |
| 5,284,731 | 2/1994 | Tyagi et al. | 430/126 |

*Primary Examiner*—Roland Martin

[57] ABSTRACT

An inverse dual-layer organic photoconductor comprising a charge generation layer (CGL) formed on top of a charge transport layer (CTL), in turn formed on a substrate such as a web (drum) or subbing layer, is disclosed, in which the CGL includes a flexible polymer having a glass transition temperature ($T_g$) of less than about 120° C. as the binder for a charge generation species and in which the CTL includes a rigid polymer having a $T_g$ of greater than about 120° C. as the binder for a charge transport species. The CTL is coated onto the substrate, using a non-chlorinated solvent. The CGL is coated onto the CTL, also using a non-chlorinated solvent, under conditions so as to form a diffused region at the boundary of the CGL and CTL. This type of photoconductor yields extremely low noise, exceptionally high-speed and excellent stable charging/discharging performance in the xerography process at room temperature and elevated temperature.

23 Claims, 4 Drawing Sheets

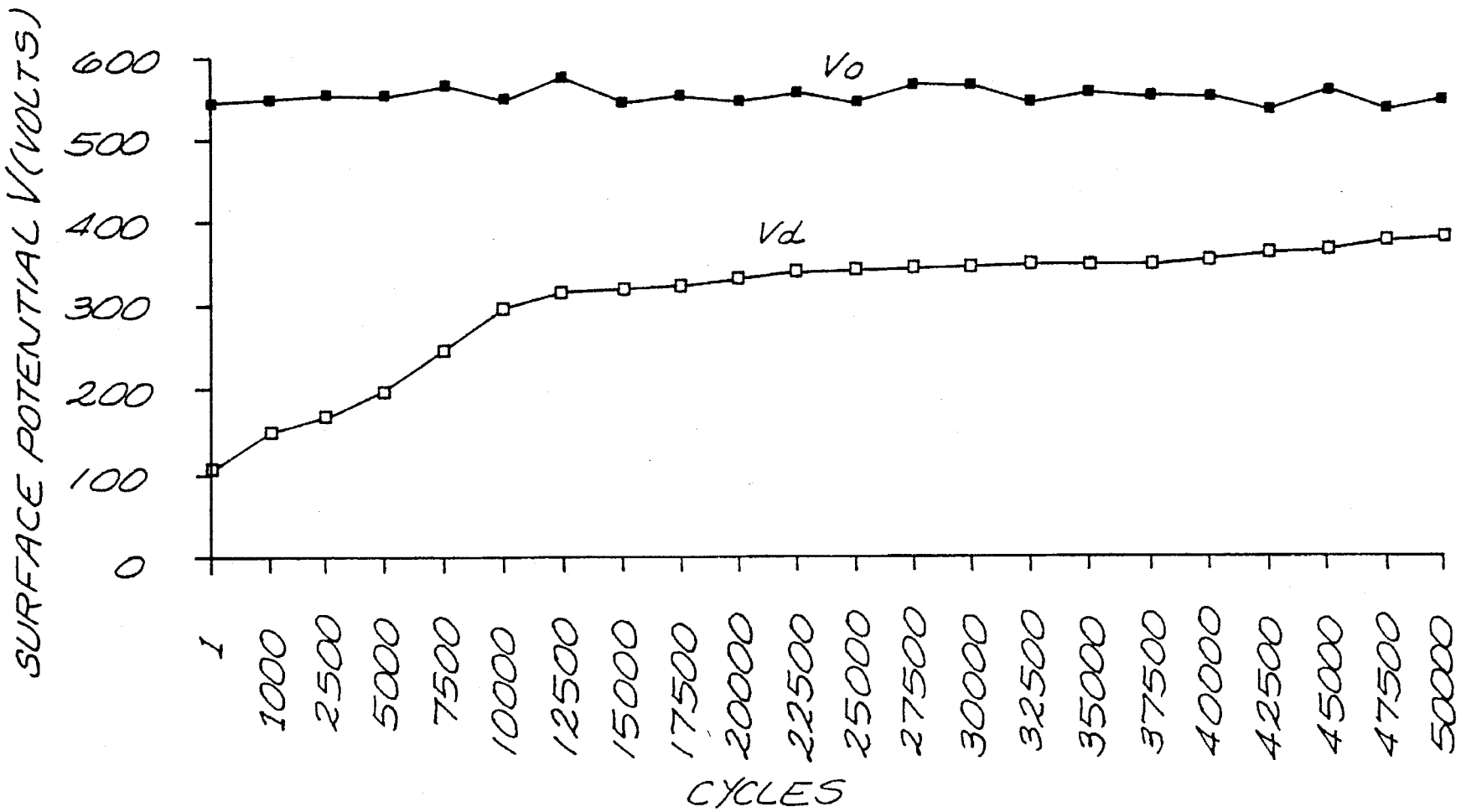
FIG. 3 (COMPARISON)

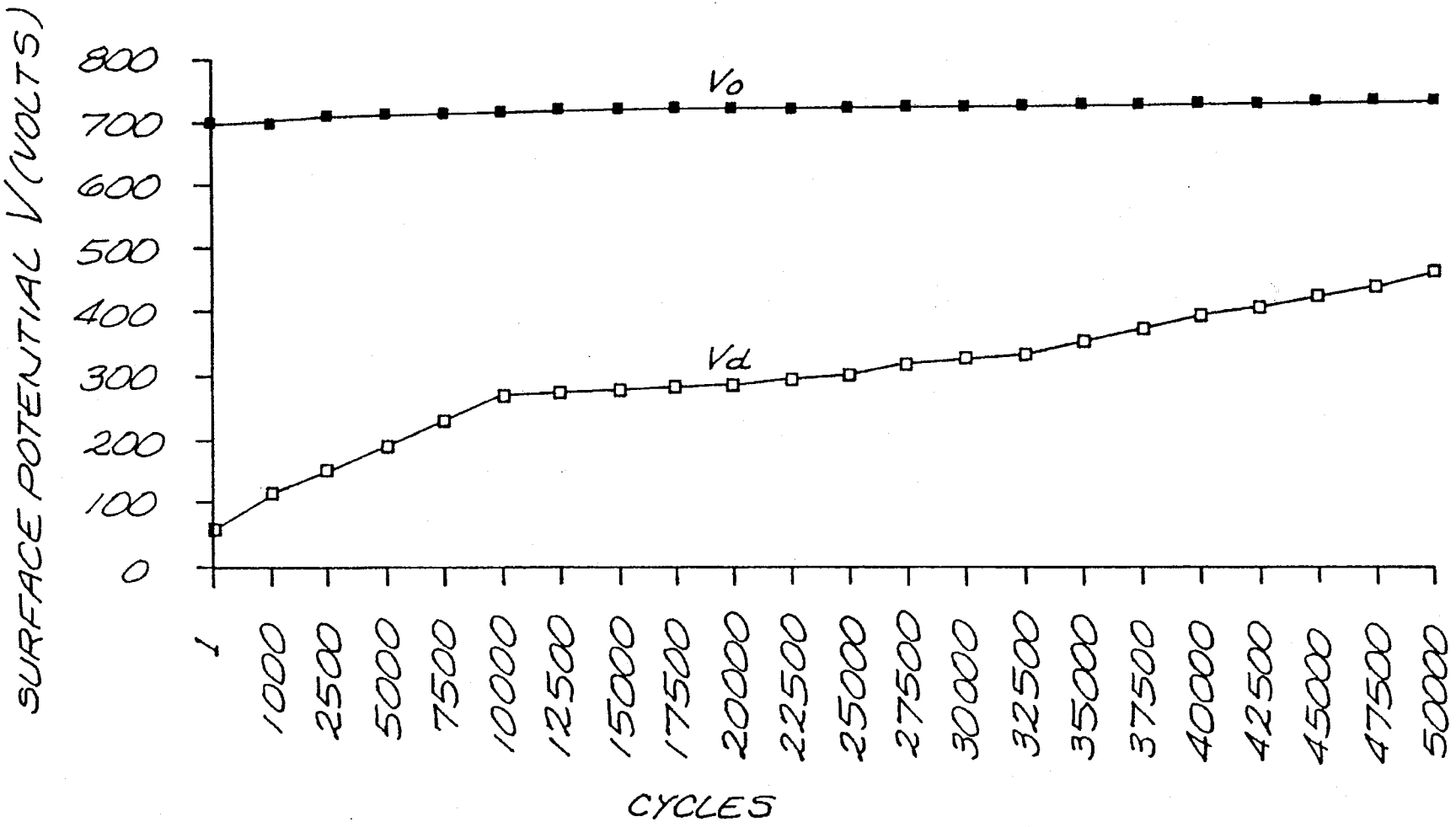
FIG. 4 (COMPARISON)

DIFFUSION COATING PROCESS OF MAKING INVERSE COMPOSITE DUAL-LAYER ORGANIC PHOTOCONDUCTOR

CROSS REFERENCE TO RELATED APPLICATION

This is a divisional of copending application Ser. No. 08/287,437 filed on Aug. 8, 1994 pending.

TECHNICAL FIELD

The present invention relates generally to image transfer technology and, more particularly, to electrophotography, employing a positive charging, organic photoconductor material including polymeric binders.

BACKGROUND ART

Electrophotographic (EP) laser printing employs a toner containing pigment components and thermoplastic components for transferring a latent image formed on selected areas of the surface of an insulating, photoconducting material to an image receiver, such as plain paper, coated paper, transparent substrate (electrically conducting or insulative), or an intermediate transfer medium.

There is a demand in the laser printer industry for multicolored images. The image quality can be enhanced by a large number of approaches, including the technique which utilizes small particle developer including dry toner having an average particle size less than 5 μm; see, e.g., U.S. Pat. Nos. 4,927,727; 4,968,578; 5,037,718; and 5,284,731. However, it has also been known that the electrophotographic dry toner having particle size less than 1 μm is very hard to prepare due to increased specific area, and consequently, liquid toner has become one of the solutions for practical preparation of sub-micrometer xerographic developer.

Liquid toners comprise pigment components and thermoplastic components dispersed in a liquid carrier medium, usually special hydrocarbon liquids. With liquid toners, it has been discovered that the basic printing color (yellow, magenta, cyan, and black) may be applied sequentially to a photoconductor surface, and from there to a sheet of paper or intermediate transfer medium to produce a multi-colored image.

Recently, there has been an increased demand of environmental safety. The industrial response to this requirement has been the investigation of safer solvents for organic coatings. However, in the field of the photoconductor technology, the use of non-chlorinated solvents requires overcoming some challenges in the formulation of the photoconductors, because in the many photoconductor products comprising organic coatings, the best performance is easily achieved with chlorinated solvents, including the stable dispersion of organic pigments and dyes, the uniformity of the coating due to the best compatibility between the photoconductor elements, and the optimum solubility of the binder when the coating solution is made of chlorinated solvents. Thus, there is a need to combine the appropriate photoconductor elements in a non-chlorinated solvent-coating formulation so that the basic performance of the photoconductor can be achieved.

Thus, binders which exhibit satisfactory dispersion performance of the meta-stable pigment crystal forms are not always available when the non-chlorinated solvents are used.

Description of Dual Layer OPC

The organic photoconductor products in the market today, generally speaking, are dual layer OPCs, which comprise a charge generation layer (CGL) and a charge transport layer (CTL) as key components. In addition to these layers, the photoconductor body can be undercoated or overcoated with other materials to improve adhesion to the substrate or to improve surface wear resistance or to reduce the surface adhesion for improved image transfer efficiency. The organic photoconductor (OPC) with an additional undercoating layer or overcoating layer becomes an organic photoreceptor (OPR) and ready for use in various designs of electrophotographic systems.

Most of the multilayer OPRs in the market are negative charging OPCs in which the thick hole transport layer is located on the top of the thin CGL. This is called the standard, or conventional, dual layer OPC. In the conventional case, the CGL usually comprises a photoconductive pigment or dye dispersed in an inert binder, with a pigment/dye content ranging up to about 90 wt %. 100% pigment in the CGL is possible where the pigment CGL is vacuum-evaporated in the format of a thin film; see, e.g., U.S. Pat. No. 4,578,334. Besides dispersion stabilizing functions, the CGL binder also plays an important role of adhesion.

The choice of CGL binder in the conventional dual layer OPC is not very critical, because the CGL is very thin and the binder content is less than 50 wt % in general to ensure a good contact between charge generator (pigment or dye) and charge transport molecule. The good contact between charge generation molecule (CGM) and charge transport molecule (CTM) is the most critical requirement for the high efficiency of charge generation and charge injection of the photoinduced carriers from CGL into CTL if the ionization potential of the charge generation molecule and the charge transport molecule are well-matched and if the electric field crossed over between the two layers is high enough to cause the charge generation, the charge injection, and the charge transport actions.

In reality, the "good contact" between CGM and CTM of a conventional dual layer OPC is formed during the coating of the CTL on the CGL, because the thicker CTL coating needs longer drying time and the coating solvent has an opportunity to create a mixing zone at the CTL/CGL interface due to the slight solubility of the pigment or dye charge generation molecules in the CTL coating solvent. It has been known that the chlorinated solvents, such as dichloromethane (DCM), trichloroethane (TCE), etc., offer the best performance for the formulation of conventional dual layer OPC for two reasons: (1) chlorinated solvents are the best choice for the solubility of most of the binders which can be used for the CTL, such as polycarbonates, and (2) they are also able to create a "slight dissolving" of the pigment or dye CGMs required for forming a mixing zone of CGL/CTL.

Problems of Inverted Dual Layer OPCs

In contrast to the conventional dual layer OPCs for negative charging, an inverted dual layer OPC utilizing the hole transport molecule in the CTL is employed to provide the positive charging OPCs.

In this case, the CGL is deposited on the top of the CTL. Due to the fact that the thinner CGL coating requires much less amount of coating solution and the CGL coating can be dried faster, then the mixing zone of CTM and CGM is harder to form in an inverted dual layer OPC. Thus, the speed of an inverted dual layer OPC becomes poorer than the conventional dual layer OPC, especially when the CGL coating is derived from a non-solvent of the CTL. The situation becomes worse when non-chlorinated solvents are used for forming the coatings on a substrate, because many polymers show poorer solubility in non-chlorinated solvents than in chlorinated solvents. "Better contact" (in the mixing zone) can be achieved by increasing the CGM pigment or dye content in the CGL, for example, above 50 wt %, as disclosed in U.S. Pat. No. 4,948,687. When the solid percentage of pigment or dye CGM in CGL is above 50 wt %, the volume percent can reach the level of 60 to 70 vol %, depending on the density of CGM. Then, there are several issues related to high CGM dispersion coating. First, the poor dispersion stability is caused by the low coverage of dispersion binders on the surface of individual CGM particles. The poor dispersion stability is also caused by the agglomeration or cluster of CGM. Second, the CGM is the most vulnerable component of the photoconductor device, so that the higher the pigment or dye concentration on the surface, the more easily the following disadvantages occur:

(a) surface charge injection, which tends to decrease dark decay with repeat cycle; and (b) low wear resistance, which reduces the device life and so it is necessary to have a very strong surface protection, which increases the manufacturing cost and reduces productivity; see, e.g., U.S. Pat. Nos. 5,240,802 and 4,409,309.

The addition of CTM into the CGL is one of the solutions to improve the formation of the mixing zone of CGM/CTM in the formulation of the inverted dual layer OPC; see, e.g., U.S. Pat. No. 4,968,579. However, in this case, the selection of CGL binder is more critical because it must simultaneously satisfy three basic requirements:

(a) be soluble in non-chlorinated solvents;

(b) form a stable dispersion with the charge generation molecule (pigment or dye); and (c) be compatible with the CTM. The poor compatibility between CTM and binder exhibits recrystallization of CTM in a dried film and poorer performance stability.

In order to satisfy the compatibility between CTM and CGL binder, the CGL binder has been chosen to be the same binder as the CTL binder, which is currently and practically a polycarbonate; see, e.g., U.S. Pat. No. 4,968,579. Furthermore, it is observed in many cases, including U.S. Pat. No. 4,968,579, that polymers having a ring in the main chain, such as polycarbonates and polyesters, can provide desirable compatibility with CTM, but they are not able to provide a satisfactory dispersion of pigments or dyes utilized as charge generation molecules. The phenomenon becomes worse when a non-chlorinated solvent is used as a dispersion solvent due to its lower polarity than chlorinated solvents. In this case, a relatively low loading CTM such as 10 wt % or less must be used in order to achieve dispersion and this results in insufficient light absorption efficiency due to the small amount of CTM in CGL. So, in order to achieve enough light absorption efficiency, the device requires relatively thick CGL such as in the range of 10 μm. This kind of thickness easily causes a charge build-up effect due to charge trapping phenomenon in such a heterogeneous phase.

Moreover, the satisfactory .dispersion is defined by particle size less than 1 μm in the disperse media after coating finish. The satisfactory dispersion is also determined by the glossiness of the finish coating surface. The agglomeration of dispersed pigment or dye CTM can be observed by evaluation of the glossiness of the coating which has been dried enough, especially when the pigment or dye content in the coating is above 5 wt %: the glossier the coating, the better the dispersion stability. The above-described satisfactory dispersion is called a "super dispersion", which is preferred in order to achieve very low noise and a low graininess image such as the photographic quality achieved by silver halide imaging materials. In this case, the chlorinated coating solvents such as dichloromethane, trichloroethane, and chloroform have been known to facilitate somehow the dispersion quality, even though that dispersion quality is not totally equivalent to a "super dispersion" quality. Of course, these chlorinated solvents are no longer preferred for industrial scale-up due to the environmental concerns mentioned above.

Not only are the super dispersion characteristics required for high image quality, but also the physical arrangement of pigment or dye CGM strongly affects the reliability of the device performance. The agglomeration of the CGM can enhance the positive surface charge injection known as surface charge leak current; see, e.g., U.S. Pat. No. 4,444,862. So, the more uniformly the CGM is dispersed throughout the CGL, the better the performance reliability.

For example, polyvinyl butyral (PVB) is known to exhibit excellent dispersion stability with a number of meta-stable phthalocyanine pigments, with photoconductive perylene pigments in suitable non-chlorinated solvents such as methyl isobutyl ketone (MIBK), or with tetrahydrofuran (THF), but PVB is not very compatible with most of the well-known hole transport molecules, including hydrazone compounds, triaryl amine compounds, triphenyl methane compounds, and the like. On the other hand, some polycarbonates, such as Makrolon (Mobil Chemical) and polyesters (Vylon Products, Toyobo), exhibit excellent compatibility with the transport molecules, but they do not evidence a good and stable pigment dispersion in non-chlorinated solvents, including THF and toluene. Some non-chlorinated solvents have a tendency to damage the desired crystal structure of some photoconductive pigments and also to reduce the dispersion stability due to the crystal form change during milling processes.

Thus, the main purpose of the present invention is to provide a coating formulation of an inverted dual layer OPC for positive charging with the following benefits:

(a) utilize non-chlorinated solvents for the coating process, including dissolving, milling, mixing, and coating;

(b) achieve excellent dispersion or super dispersion of CGM in CGL and achieve excellent uniformity of the coating; and (c) achieve comparable speed as the conventional dual layer OPC using the same materials and superior life cycle.

DISCLOSURE OF INVENTION

In accordance with the present invention, an improved inverse composite dual-layer organic photoconductor is provided, along with a diffusion coating process for forming the same. In the inverse composite dual-layer OPC, the charge transport layer, which is formed on a substrate or subbing layer, comprises a rigid polymer Chain (denoted polymer B) as the binder and a charge transport molecule (CTM), specifically, a hole transport molecule, and the charge generation layer, which is formed on the charge transport layer, comprises a flexible polymer chain (denoted polymer A) and a charge generation molecule (CGM).

In the process of the invention, non-chlorinated solvents are used to apply the CTL and CGL coatings to form the electrophotographic element. The layers are applied to the surface of a substrate, such as a web, e.g., a drum, with or without a subbing layer, by forming solutions of the respective components in a non-chlorinated solvent. Specifically, the charge transport layer is applied to the substrate by (1) preparing a first solution of the charge transport molecule and associated polymer B in at least one non-chlorinated solvent, (2) coating the substrate with the first solution, and (3) evaporating the non-chlorinated solvent to leave the charge transport layer on the substrate. The charge generation layer is applied to the charge transport layer by (1) preparing a second solution of the dye or pigment and associated polymer A in at least one non-chlorinated solvent, (2) coating the charge transport layer with the second solution, and (3) evaporating the non-chlorinated solvent to (a) leave the charge generation layer on the charge transport layer and (b) form a diffused region between the two layers.

Polymer A is selected from the group of thermoplastic and thermoset polymers which exhibit a large degree of flexibility in the polymer conformation due to its flexible backbone. In general, the thermoplastic polymer A also belongs to lower $T_g$ (glass transition temperature) categories, generally, lower than about 120° C. The thermoset polymer A comprises crosslinked thermoplastic polymer A. Vinyl polymers comprising addition polymerization products based on the generation of free radical utilizing initiator may be used as thermoplastic polymer A.

Polymer B is selected from the group of polycondensation product polymers or specific vinyl polymers which exhibit less flexibility of polymer conformation due to the presence of rigid functional groups on the polymer main chain. In general, polymer B belongs to higher $T_g$ categories, generally, higher than about 120° C.

On the other hand, if the solution of polymer B (rigid) is added into the solid phase of polymer A (flexible), the same effect does not happen. The final solid state product of the mixture shows a hazy translucency rather than that of a clear transparency.

These findings in the present invention may be explained as the effect of the penetrating of flexible polymer A liquid into the solid network of rigid polymer B.

Taking advantage of this phenomenon, a solution of CGL coating comprising dispersed pigment and flexible polymer A is coated on the top of the solid layer of the CTL made of rigid polymer B. The resulting product shows excellent coating uniformity of the finished surface and the dispersion of the pigment after coating is stabilized at the mixing zone of CGL and CTL. It should be noted that, in general, the uniformity of the surface coating of a heterogeneous phase, such as pigment dispersion, can be damaged after being dried due to the incompatibility between pigment and binder and that the CGL binder or CTL binder itself does not exhibit excellent dispersion stability of pigment or dye molecules in coating solvents, especially non-chlorinated and less polar solvents.

Furthermore, due to the favorable and limited diffusion of the CGL materials into the top layer of the CTL, a mixing zone between CGM and CTM is well-formed in a thin diffusion layer and ensures good performance (both speed and life) of the OPC.

Besides the choice of suitable polymeric materials, the penetration of the A polymer into the B polymer network can be enhanced by heat and pressure. Pressure is not critical for the coating process of the invention compared to heat application, as discussed in greater detail below.

Principle of the Diffusion Coating Process

The concept of the diffusion coating process of the present invention in association with non-chlorinated solvents follows:

The present inventors have found that different kinds of polymer conformation, specifically, a flexible polymer chain (polymer A) and a rigid polymer chain (polymer B), when blended in the same non-chlorinated and less polar solvent, show different compatibility than a polymer blend of the same type of conformation (flexible-flexible or rigid-rigid).

Because of the different conformational behavior in solution, the two types of polymers (polymer A and polymer B) do not need to be totally compatible, that is, a phase separation is observed when they are mixed together in the same non-chlorinated solvent. The phase separation is observed by the appearance of a translucent liquid rather than a totally transparent liquid of the mixture.

When a solution of polymer A (flexible) is added into a solid state of the polymer B (rigid), the solvent causes swelling of polymer B, followed by penetration of the polymer A chain into the rigid network of the solid phase of polymer B.

The penetration reaches equilibrium along with the evaporation of the solvent, and the polymer A chain can interpenetrate and stabilize its physical arrangement between the B polymer chain's physical structure. After being totally dried, the product of the mixture exhibits a clear transparency.

Materials Applicable to the Diffusion Coating Process

There is a need to carefully select suitable A and B polymers in combination for CGL and CTL, respectively, to meet the specification of the above-mentioned diffusion coating process. However, while such careful selection will require some experimentation, such experimentation is not considered undue in view of the teachings herein.

The selection of polymer A for the CGL binder is based on the following criteria:

(a) solubility in non-chlorinated solvents;

(b) pigment or dye dispersion stability; and (c) flexibility of the polymer conformation (as measured by $T_g$).

The flexible polymer A for CGL is selected from the group of vinyl polymers listed below (I, II, III) and poly dimethyl siloxane (IV), having $T_g$ below 120° C.:

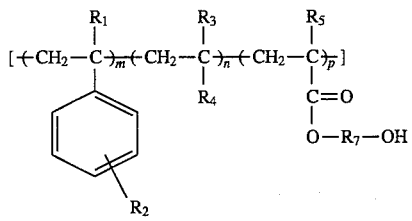

(I)

-continued (II)

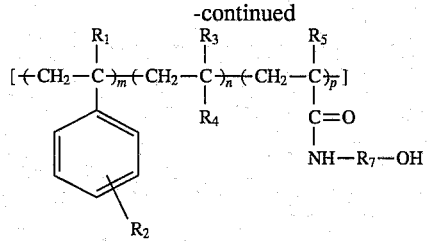

(III)

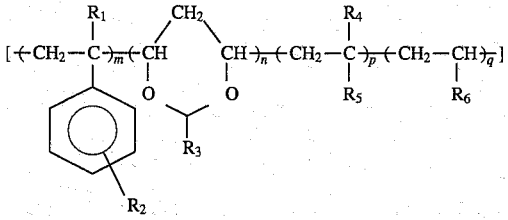

where $R_1$, $R_2$, $R_3$, $R_4$, $R_5$, and $R_6$ are independently selected from the group consisting of H, alkyl, cycloalkyl, alkenyl, alkoxy, aryl, and substituted groups, $R_7$ is selected from the group consisting of alkyl, cycloalkyl, alkenyl, alkoxy, aryl, and substituted groups, m ranges from 0 to 100, n, p, and q each range from 0 to 50, m+n+p=100, and m+n+p+q=100; and, (IV)

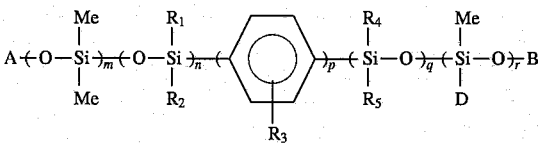

A, B or D = 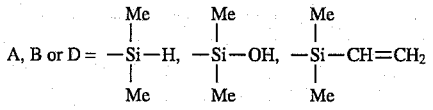

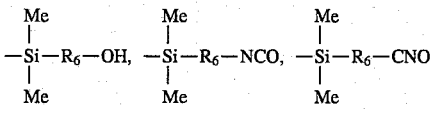

where $R_1$, $R_2$, $R_3$, $R_4$, $R_5$, and $R_6$ are independently selected from the group consisting of alkyl, substituted alkyl, aryl, and substituted aryl groups, m, n, q, and r each range from 10 to 100, p ranges from 0 to 50, and m+n+p+q+r=100.

Depending on the baking conditions of the CGL, this layer can be a thermoplastic layer or a thermoset layer.

The selection of polymer B for the CTL binder is based on the following criteria:

(a) solubility in non-chlorinated solvents;

(b) compatibility with transport molecules; and (c) rigidity of the polymer chain (as measured by $T_g$).

The B polymer for CTL binder is selected from a specific class of polymers having $T_g$ greater than 120° C. and containing at least one or more cycloalkyl units in the main chain of the polymer, such as polycarbonate (V) (V)

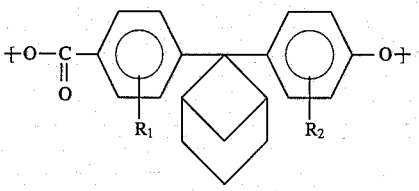

-continued polyester (VI) (VI)

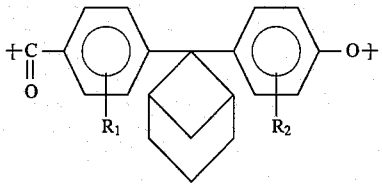

polyimide (VII) (VII)

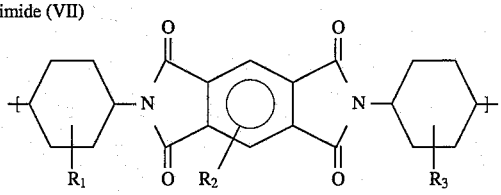

vinyl polymers (VIII, IX) (VIII)

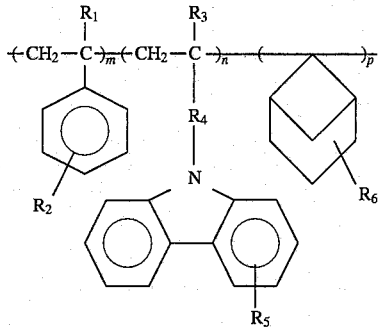

(IX)

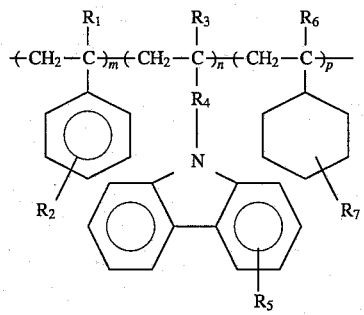

polysilane (X) (X)

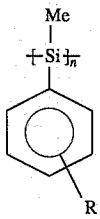

polygermane (XI) (XI)

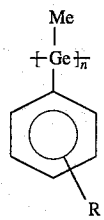

where R, $R_1$, $R_2$, $R_3$, $R_4$, $R_5$, $R_6$, and $R_7$ are independently selected from the group consisting of H, alkyl, cycloalkyl, alkenyl, alkoxy, aryl, and substituted groups, m, n, and p each range from 5 to 50, and m+n+p =100.

The non-chlorinated solvents for CTL binder are selected from the group consisting of ketones (e.g., acetone, methyl ethyl ketone, methyl iso-butyl ketone (MIBK), and cyclohexanone), aromatic hydrocarbons (e.g., toluene, xylene), tetrahydrofuran (THF), and alcohols (e.g., methanol, ethanol, and iso-propanol). These solvents may be used alone or in a combination with one or more other such non-chlorinated solvents to adjust the drying time.

The inverse composite dual layer OPC of the present invention evidences improved performance and stability over prior art inverse composite dual layer OPCs; see, e.g., U.S. Pat. Nos. 4,968,579; 4,409,309; and 4,948,687. The specific combination of polymer A and polymer B, as disclosed above, permits use of non-chlorinated solvents, resulting in very good uniformity of the coating, very high speed operation, and very stable performance. The ability to form a good diffused mixing zone permits use of a thinner CGL, on the order of 10 μm or less, which reduces the need for a thicker CGL and yet maintains the higher light absorption efficiency associated with the thicker prior art CGL.

BRIEF DESCRIPTION OF THE DRAWINGS

FIG. 3 is a plot similar to that of FIG. 2, but employing the same polymer as binder for both the CGL and CTL; and FIG. 4 is a plot similar to that of FIG. 2, but employing the composition of FIG. 3 as modified by the presence of a hole transport molecule.

BEST MODES FOR CARRYING OUT THE INVENTION

Figure 1:
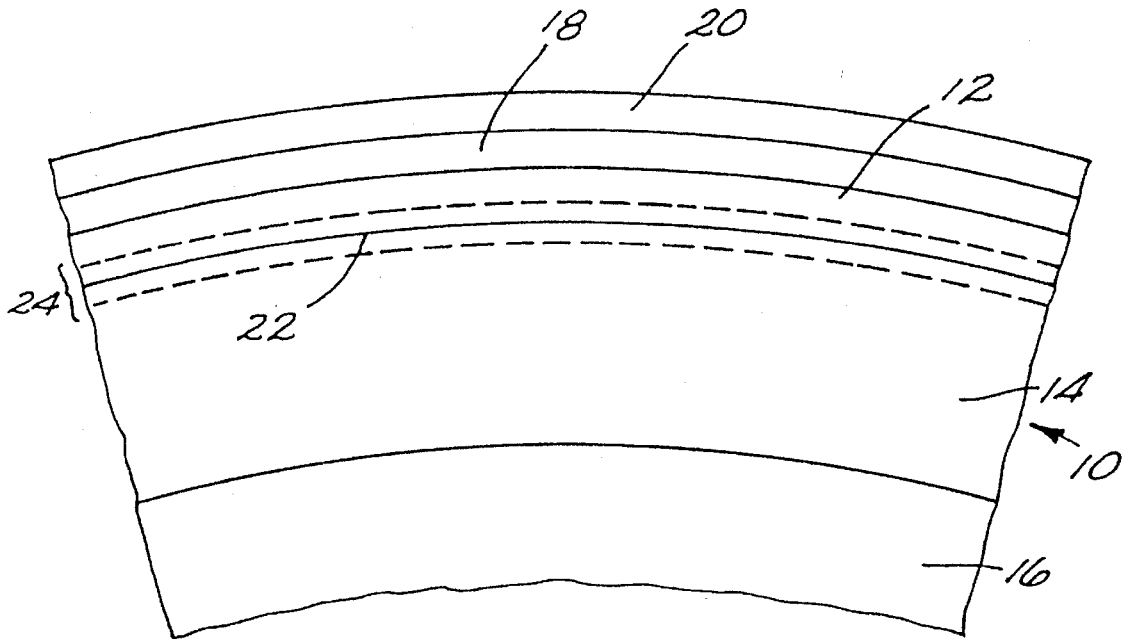
FIG. 1 is a cross-sectional view, depicting the inverse composite dual-layer organic photoconductor (OPC) of the present invention, comprising a charge generation layer formed on top of a charge transport layer, the charge transport layer in turn formed on top of a conductive substrate, with or without an undercoating layer (UCL)

FIG. 1 depicts an inverse composite dual-layer organic photoconductor (OPC) 10, comprising a charge generation layer 12 which is formed on top of a charge transport layer 14. The dual layer organic photoconductor in turn is formed on a substrate 16, such as a web or subbing layer to improve adhesion to an underlying web (not shown). The web, e.g., drum, is used as a component in electrophotographic printers and copiers, as is well-known.

A barrier layer 18 may optionally be formed on top of the CGL 12 to avoid positive charge injection from the surface of the OPC 10 into the body of the OPC. In addition, a release layer 20 may optionally be formed as the outermost layer. The release layer 20 is used with a liquid toner, but is not necessary if a solid toner is used with the OPC 10. A common material used for the release layer 20 is one of a number of poly(dimethylsiloxane) derivatives or blends or other polymer(s) having a surface adhesion less than 50 dyne/cm.

The basic elements of the structure shown in FIG. 1 are known. It will be noted that this structure is the inverse of the situation in which the charge transport layer is formed on top of the charge generation layer. In that instance, the uniformity of the charge generation layer is not critical. However, in the case of the inverse structure, shown in FIG. 1, uniformity of the charge generation layer 12 is critical to good performance of the electrophotographic printing process, and such uniformity contributes to high speed and stable performance.

The compatibility between the binder and the charge transport molecule (CTM) and between the binder and the pigment/dye (charge generation molecule, or CGM) is not the same. These components tend to dissolve into each other, with no precipitation or recrystallization. Rather, they tend to form a homogeneous phase, with no phase separation. To form a good coating, the binder and CTM must be in the same phase, and there must be a good dispersion of CGM in the binder.

The molecular weight of each binder and chemical functional group will affect the interface 22 between the charge generation layer 12 and the charge transport layer 14, due to different binders. Thus, it is desirable to obtain the best combination of properties.

Further, there is a need to use non-chlorinated solvents, due to environmental concerns. Not many binders are soluble in non-chlorinated solvents, examples of which include tetrahydrofuran (THF), iso-propanol (IPA), toluene, and ketones (acetone, methyl iso-butyl ketone, methyl ethyl ketone, and the like).

In accordance with the present invention, a first polymer, designated polymer A, is used in the charge generation layer 12 and comprises specific vinyl polymers, as described in greater detail below, while a second polymer, designated polymer B, is used in the charge transport layer 14 and comprises polymers having cycloalkyl rings attached thereto, also as described in greater detail below. The average molecular weight of polymer A is in the range of about 30,000 to 3,000,000, and preferably about 800,000 to 1,000,000 for optimum performance. The average molecular weight of polymer B is in the range of about 10,000 to 3,000,000.

The foregoing combination allows use of a non-chlorinated solvent, resulting in very good uniformity of the coating, very high speed operation, and very stable performance.

Examples of A polymers for CGL include:

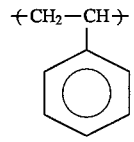
A-1)

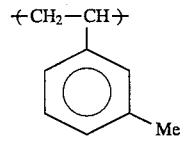
A-2)

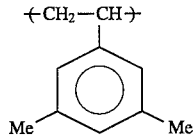
A-3)

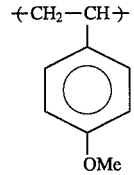
A-4)

-continued
A-5)
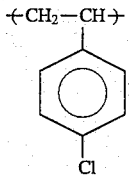
A-6)
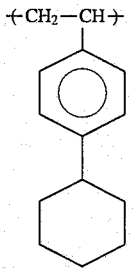
A-7)
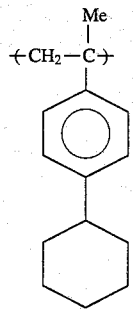
A-8)
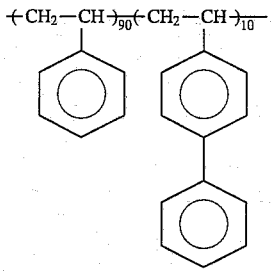
A-9)
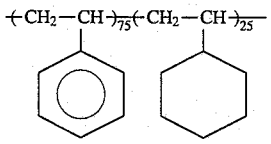
A-10)
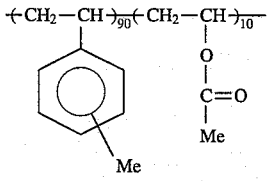
A-11)
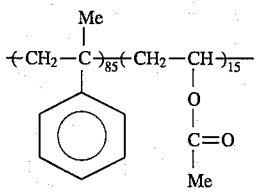
-continued
A-12)
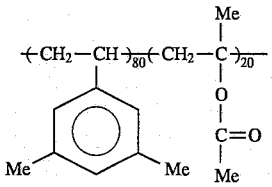
A-13)
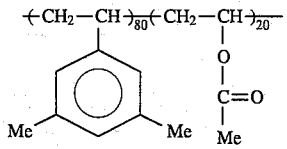
A-14)
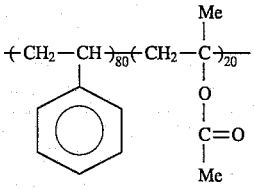
A-15)
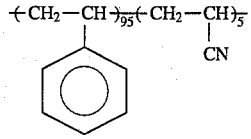
A-16)
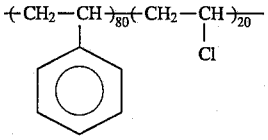
A-17)
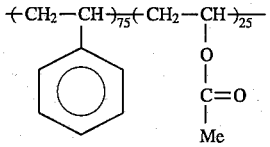
A-18)
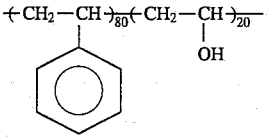
A-19)
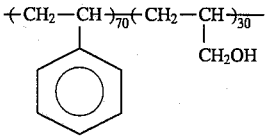
A-20)
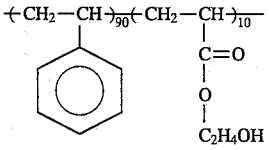
A-21)
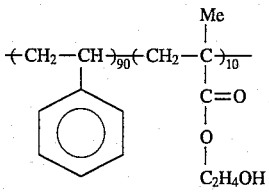

-continued
A-22)
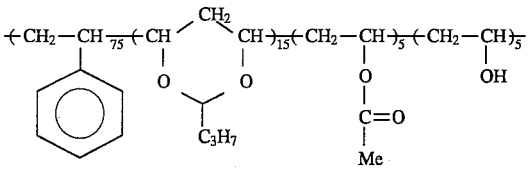
A-23)
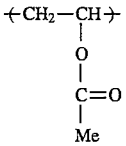
A-24)
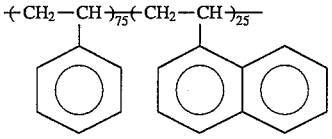
A-25)
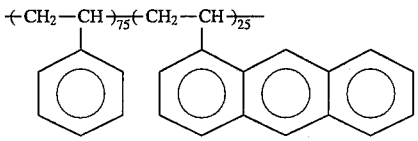
A-26)
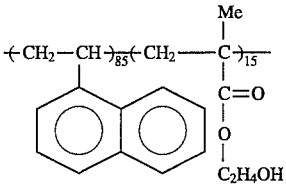
A-27)
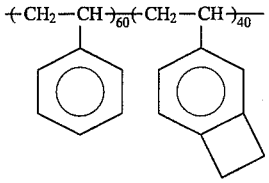
-continued
A-28)
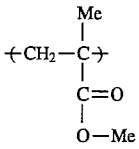
A-29)
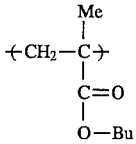
A-30)
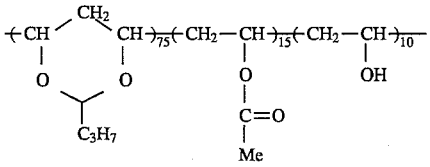
A-31)
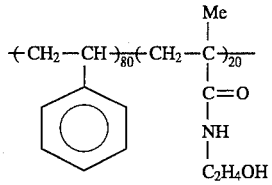
A-32)
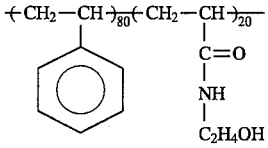
Examples of B polymers for CTL include:
B-1)
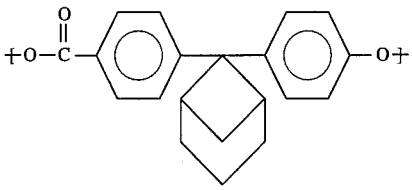
B-2)
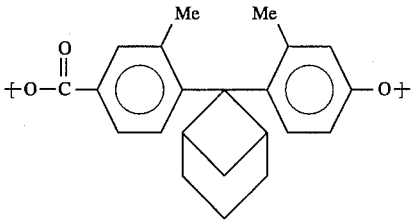
B-3)
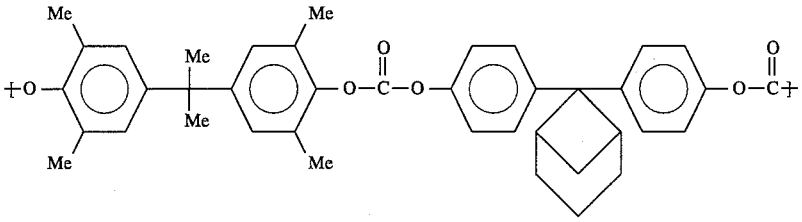
B-4)
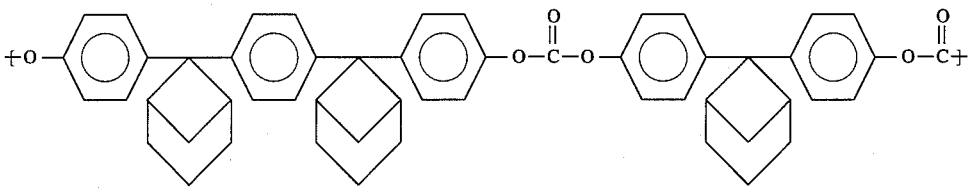

-continued
B-5)
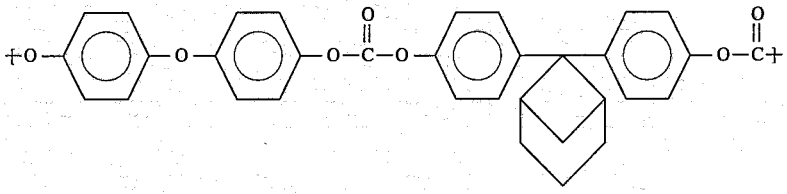
B-6)
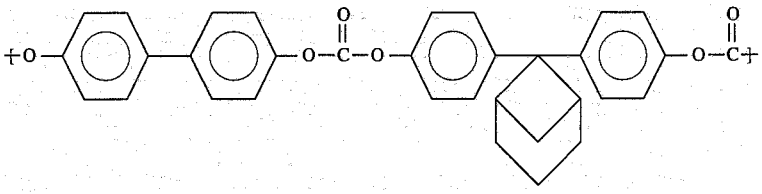
B-7)
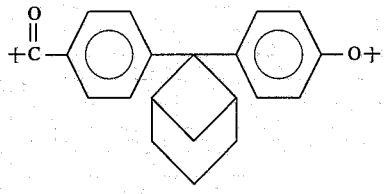
B-8)
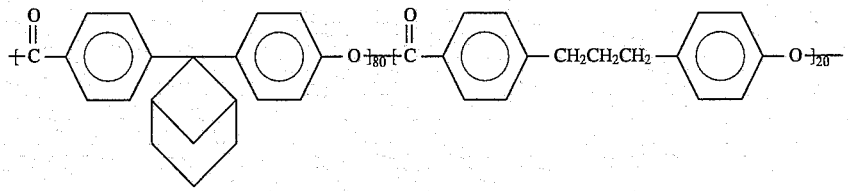
B-9)
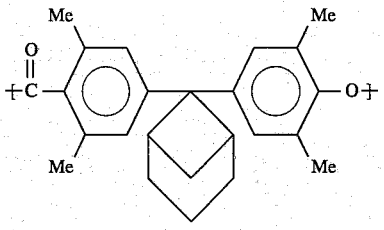
B-10)
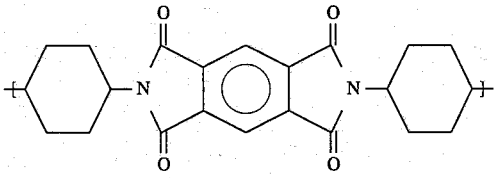
B-11)
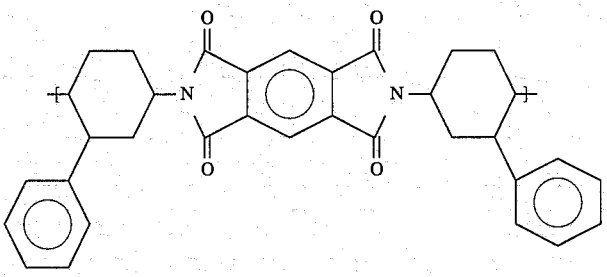
B-12)
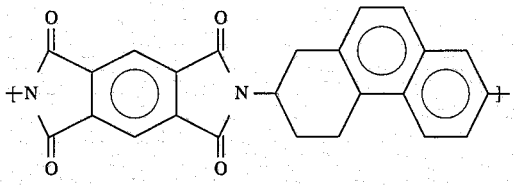
B-13)
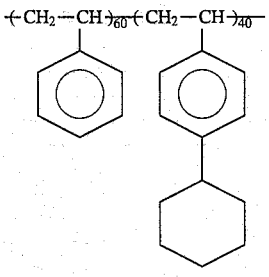

-continued

B-14)

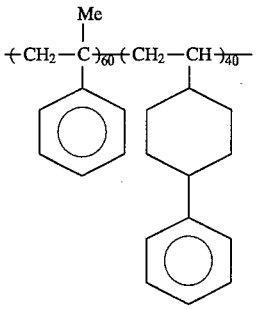

B-15)

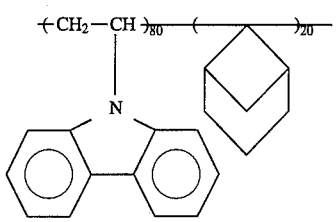

B-16)

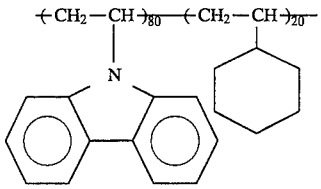

B-17)

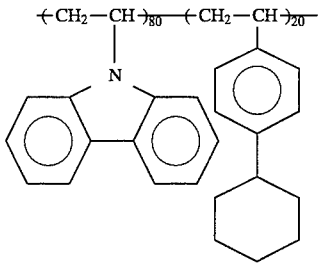

B-18)

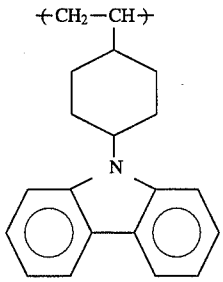

B-19)

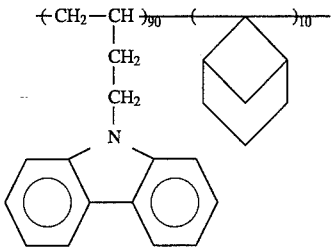

B-20)

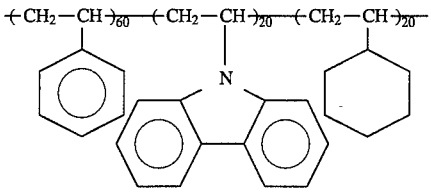

In general, the binder in the charge transport layer 14 (polymer B) must carry the cycloalkyl ring. However, certain polymers, such as polysilane and polygermane, may also be used as polymer B. The binder in the charge generation layer 12 (polymer A) need not include the cycloalkyl ring, but it may so include it.

In the fabrication of the charge generation and charge transport layers employing the process of the present invention, a diffused region 24 is formed at the interface between the two layers. This diffused region 24 provides good uniformity of the coating and surface finish, excellent adhesion, and excellent performance (high speed and stable charge).

If the diffused region 24 is absent, then the interface 20 between the two layers 12 and 14 is obtained. No bonding occurs, and liquid runs off during coating. To create this diffused region 24, the charge transport layer 14 must act like an acceptor and the charge generation layer 12 must act like a donor.

The coating of the charge generation layer 14 on the charge transport layer 12 is accomplished by forming a solution of the binder (polymer A) plus dye or pigment comprising the charge generation layer in a non-chlorinated solvent and applying the coating to the charge transport layer. As indicated above, the diffused region 24 is created by controlling the solids content, the coating speed, vapor pressure of the solvent, and binder content. The penetration of CGL into CTL is dependent on the time when the CGL solution is in contact with the CTL surface. This timing can be controlled by the coating speed and the drying speed; the drying temperature is discussed below.

The charge generation molecules are selected from a large range of photoconductive pigments and dyes which exhibit stable dispersion in suitable non-chlorinated solvents and polymer A systems. These include:

(a) the metastable form of phthalocyanine pigments: x-form, tau-form of metal-free phthalocyanine pigment (x-$H_2$Pc), alpha-, epsilon-, beta-form of copper phthalocyanine pigment (CuPc), titanyl phthalocyanine pigments ($TiOPcX_4$, where X is H, F, Cl, Br, I), vanadyl phthalocyanine pigment (VOPc), magnesium phthalocyanine pigment (MgPc), zinc phthalocyanine pigment (ZnPc), chloroindium phthalocyanine pigment (ClInPc), bromoindium phthalocyanine pigment (BrInPc), chloroaluminum phthalocyanine pigment (ClAlPc), and the like;

(b) pyrollo pyrole pigments;

(c) tetracarboximide perylene pigments;

(d) anthanthrone pigments;

(e) bis-azo, -trisazo, and -tetrakisazo pigments;

(f) zinc oxide pigment;

(g) cadmium sulfide pigment;

(h) hexagonal selenium;

(i) squarylium dyes; and (j) pyrilium dyes.

The coating speed is in the range of about 0.01 to 5 inch/see; while the solids content of the solution ranges from about 0.01 to 20 wt %. The coating speed is also dependent on the amount of the penetrating polymer in the CGL solution. The binder content in CGL may vary in the range of about 30 to 99.99 wt %. The preferable range is about 50 to 98 wt %. Optimum penetration occurs typically within a few seconds, under the conditions outlined above. The resulting charge generation layer 14 ranges from about 0.05 to 10 μm in thickness. Preferably, the thickness of the CGL 14 is less than about 5 μm.

Practice of Diffusion Process of the Invention

The following considerations apply in the diffusion process:

(i) The CGL coating solvents must be able to at least partially dissolve the CTL binder. Such dissolution depends on the contact time (time of exposure of the binder to the solution, which corresponds to the coating speed ("dissolving time"). A low solids content in the coating solution implies a higher solvent content, which aids in the partial dissolution of the CTL binder by the CGL coating solvents. The maximum amount of the CTL binder that may be desirably dissolved in the CGL solvents during the coating process is less than about 50 wt %.

(ii) The penetration of CGL into CTL can be controlled by the liquid concentration of the CGL solution which has to be coated onto the solid CTL, the solid content in the CGL solution, the viscosity of the coating solution, the coating speed, and the vapor pressure of the coating solvents. Preferably, the penetration of the CGL into the CTL to form the diffused region 24 is about 1 to 20% of the CTL thickness. In this connection, the CTL thickness is within the range of about 5 to 50 μm, and preferably within the range of about 10 to 20 μm.

(iii) The penetration depth can also be controlled by post-coating annealing. In this case, the drying process comprises two steps:

(1) slow-drying the solvent at an elevated temperature, preferably below its boiling point, to remove the solvent;

(2) performing an annealing step after slow-dry, to force the CGL to penetrate deeper into the CTL by heating up the dual layer structure at a temperature higher than the $T_g$ of the CTL. In this case, the annealing temperature and annealing time must be suitably selected to avoid escape of the CTM (charge transport molecule in the CTL) out of the OPC.

The slow-dry step is performed at a temperature that avoids the formation of bubbles, which would render the coating non-uniform. Penetration stops when the solvent is removed (evaporated).

The temperature of the slow-dry step is typically within the range of about 60° to 100° C.; the slow-dry step is performed for at least about ten minutes. The annealing is most effective at above 120° C. and below 150° C. for at least about ten minutes. In the practice of the present invention, it is found that the additional annealing step, which softens the CTL and makes penetration easier, significantly increases the photodischarge rate and significantly reduces the residual voltage. The CGL coating may be applied by a number of different coating processes, including dip coating, ring coating, blade coating, hopper coating, and the like.

After being baked, depending on the baking condition and the chemistry, the CGL binder can remain as a thermoplastic binder or it can be converted into a thermoset binder, which is formed by a crosslinking reaction during the annealing step. In this latter case, a crosslinker aid may be added into the CGL solution; examples of such crosslinker aids include polydiisocyanate, phenolic resins, melamine resins, epoxy, dialdehydes, anhydrides, diols, and the like. The crosslinking reaction occurs due to the reactivity of these crosslinker functional groups with the functional groups of the CGL binder. In the case of crosslinked CGL, the surface becomes tougher and more wear-resistant, as well as more solvent-resistant. The solvent-resistance feature is especially important for the use of the inverted dual layer OPC in the liquid toning process because the liquid carrier of the liquid toner includes liquid hydrocarbons, mineral oils, and other liquids that might act as a solvent and thus attack the CGL.

The present invention thus provides a solution for excellent surface coating uniformity and unusual performance of the inverse dual layer photoreceptor using non-chlorinated solvents, based on a controlled diffusion process of the charge generation layer (CGL) into the charge transport layer (CTL).

The CTL comprises hole transport molecules and binder selected from the class of rigid B polymers, described above. The hole transport molecules may be added into the CTL either as a single compound or as a combination of more than one compound.

The CGL comprises charge generation molecules and binder selected from the class of flexible A polymers, described above. Transport species, including hole transport molecules and electron transport molecules, may be added into the CGL as a single compound or as a combination of more than one compound, in order to improve charge generation efficiency.

The transport molecules are selected from a number of conventional hole transport molecules including, but not limited to, triaryl methanes, triarylamines, hydrazones, pyrazolines, oxadiazoles, styryl derivatives, carbazolyl derivatives, and thiophene derivatives or from a number of conventional electron transport molecules including, but not limited to, imino derivatives, sulfone derivatives, fluorenone derivatives, diphenoquinone derivatives, and styryl diphenoquinone derivatives.

Examples of hole transport molecules include
HT-1
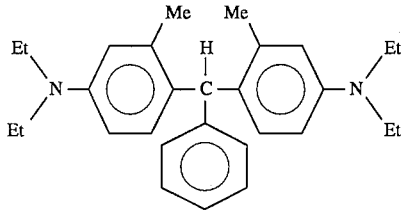
HT-2
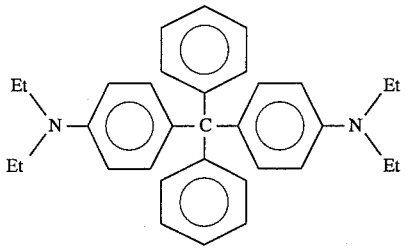
HT-3
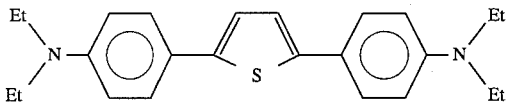
HT-4
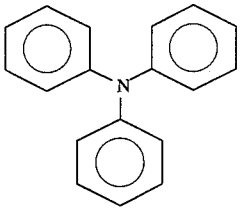
HT-5
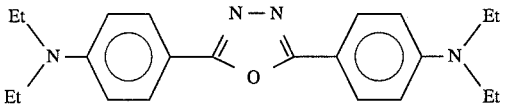
HT-6
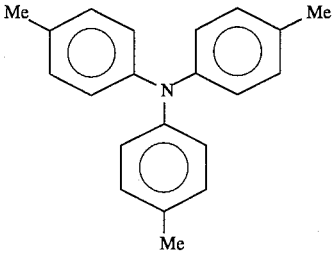
HT-7
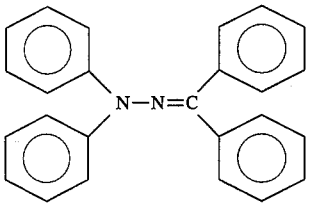
HT-8
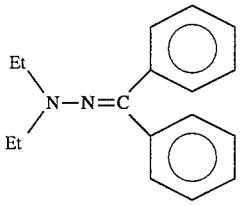
-continued
HT-9
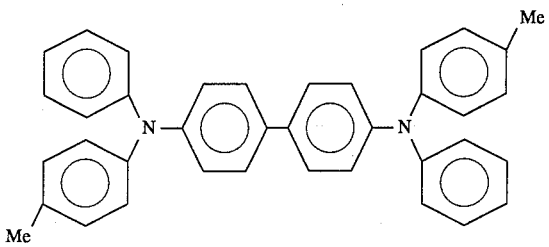
HT-10
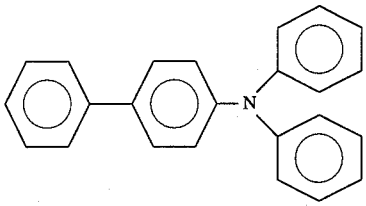
HT-11
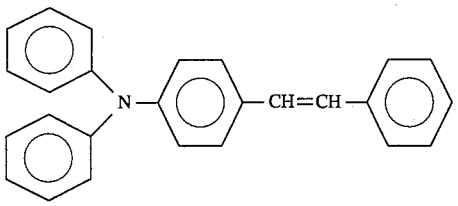
Examples of electron transport molecules include
ET-1
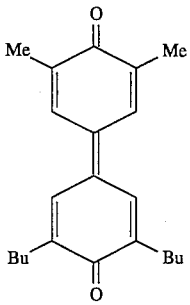
ET-2
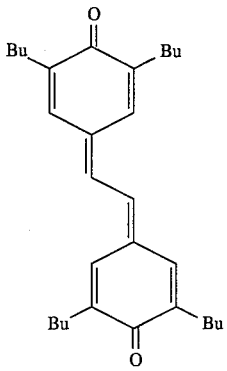
ET-3
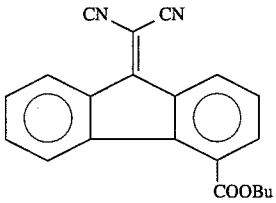

-continued

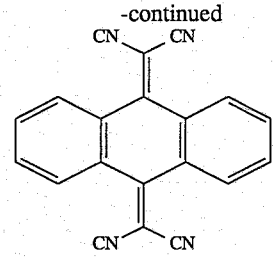

ET-4

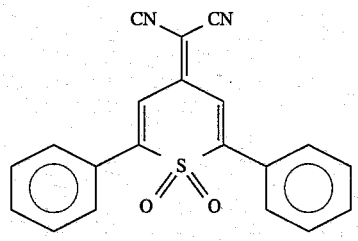

ET-5

The CGL comprises photoconductive pigments or dyes and binder selected from the class of flexible A polymers, described above.

In some cases, the CGL binder can be used as a single binder or as a combination (polymer blend) with specific binders, including polysilanes or polygermanes, to improve performance in terms of speed and surface durability.

EXAMPLES

EXAMPLES 1–19

The following examples, together with Comparative Examples 1A–1E, will clarify the uniqueness and the advantage of the diffusion coating process of the present invention, based on the interaction between penetrating polymers (A) and accepting polymers (B) in a non-chlorinated solvent environment.

Preparation of the Charge Transport Layer 60 g of polymer B (see Table I) and 40 g of hole transport compound HT-1 were dissolved in 900 g of non-chlorinated solvent S (see Table 1) to achieve a solution containing 10 wt % solids. The solution was coated onto an aluminum drum having a diameter of 135 mm, using a ring coater. The coating speed was 1 inch per second. The coating was dried at 100° C. for 2 hours to form a CTL having thickness of 20 μm.

Preparation of the Charge Generation Layer 50 g of x-metal-free phthalocyanine (x-$H_2$Pc) pigment, 50 g of polymer A (see Table 1) and 900 g of non-chlorinated solvent S (see Table I) were milled with stainless beads (3 mm diameter) in a glass jar using jar miller, for 72 hours to achieve a uniform slurry of pigment dispersion. The slurry was isolated from the milling media and had a viscosity adjusted with. solvent S and with binder A to achieve a solution having a binder content of 80 wt % and a solids content of 5 wt %. This gave rise to the CGL solution G.

Preparation of the Inverted Dual Layer by the Diffusion Coating Technique of the Present Invention The G solution (CGL solution) was poured into the neoprene ring of a ring coater, set on the Al drum carrying the CTL mentioned above. The coating speed was 0.1 inches per second. As the ring moved slowly toward the down part of the drum, the CGL started diffusing into the CTL and it could be seen by a significant difference in optical density of the diffused layer (deposited on CTL) and non-diffused layer (deposited on Al). Therefore, the diffusion efficiency may be evaluated by the reflectance density of the coated surface measured by a conventional spectrophotometer. The diffused layer exhibited an optical density of approximately 100 times higher than that of the non-diffused layer. The diffused layers were also different, based on different combination of the A and B polymers, revealing different levels of diffusion.

Xerographic Measurement

The xerographic speed of the inverted dual layer OPC was measured on a Cynthia 90 (Gentek Corporation). In this measurement, the OPC was charged with +7,000 V (corona voltage) by corona discharge and then allowed to decay in dark for 5 seconds. The OPC was exposed to a monochrome light source of 780 nm from a halogen lamp/interference filter/cut-off filter set. The xerographic evaluation was performed for the following parameters: charge acceptance $V_o$ (V), dark decay rate (V/s), photodischarge speed as energy required for 80% of charge acceptance $V_o$, and residual voltage $V_r$ (V).

TABLE I

| EXAMPLE | CTL BINDER | CGL BINDER | SOLVENT | OD | $V_o$ (V) | E1/5 (ergs/cm$^2$ |
|---|---|---|---|---|---|---|
| Ex. 1 | B-1 | A-1 | THF | 2.4 | 550 | 5.0 |
| Comp. Ex. 1A | C-1 | A-1 | THF | 0.2 | 570 | 35.0 |
| Comp. Ex. 1B | C-1 | C-1 | THF | 0.3 | 560 | 33.0 |
| Comp. Ex. 1C | A-1 | B-1 | THF | 0.25 | 570 | 30.0 |
| Comp. Ex. 1D | B-1 | B-1 | THF | 0.35 | 550 | 28.0 |
| Comp. Ex. 1E | A-1 | A-1 | THF | 0.34 | 550 | 29.0 |

It should be noted in Table I that:

(1) OD is the optical density of the CGL coated on CTL. The optical density of CGL directly coated on Al was detected to be about 0.1 for all examples. The fact that the optical density of CGL on CTL was higher than that of CGL on Al was an indication of the extent of the diffusion of CGL into CTL.

(2) Therefore, the low OD of CGL on CTL in the Comparative Examples 1A–1E indicates the poor diffusion or penetration efficiency of CGL into CTL dependent on the type of binder A and binder B selected in the combination.

(3) In Example 1, polymer B-1 (rigid) in CTL showed a good accepting effect against polymer A-1 (flexible) in CTL; thus, the surface coating exhibited the highest OD due to the most effective diffusion of CGL into CTL.

(4) The photoresponse was determined by the E1/5 (ergs/cm$^2$) as the incident energy required to discharge the initial surface potential $V_o$ to its 1/5 value. The smaller E1/5 is, the faster photoresponse becomes. Thus, from the result described in Table I, one can recognize from the correlation between OD and E1/5 that the better the CGL can diffuse into the CTL, the faster the photoresponse becomes. It is due to the better mixing zone of CGL and CTL on the surface.

(5) If the same polymer was used for both CGL binder and CTL binder, such as in Comparative Examples 1B, 1D, and 1E, the diffusion did not show comparable OD with a specific combination of two different binders as shown in Example 1.

(6) Comparative Examples 1A and 1C clearly show that there was no penetration of the CGL binder into the CTL binder.

(7) In Comparative Examples 1A and 1B, the polymer C-1 was the following compound:

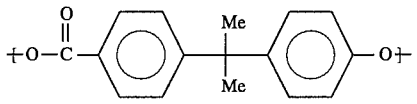

Table II below lists the results for various combinations of binder B and binder A, within the scope of the present invention. All combinations are seen to provide a diffused region (from the optical density measurement) and good operating characteristics.

TABLE II

| EXAMPLE | CTL BINDER | CGL BINDER | CGL SOLVENT | OD | $V_o$ (V) | E1/5 (ergs/cm$^2$) |
|---|---|---|---|---|---|---|
| 2 | B-2 | A-1 | THF | 2.6 | 560 | 4.85 |
| 3 | B-3 | A-1 | THF | 2.45 | 540 | 4.56 |
| 4 | B-8 | A-3 | THF | 2.50 | 554 | 2 |
| 5 | B-10 | A-1 | THF | 2.35 | 550 | 6.6 |
| 6 | B-12 | A-7 | THF | 2.27 | 80 | 7.1 |
| 7 | B-13 | A-2 | THF | 2.0 | 65 | 6.0 |
| 8 | B-16 | A-8 | THF | 2.35 | 70 | 5.5 |
| 9 | B-19 | A-10 | THF | 2.5 | 570 | 4.96 |
| 10 | B-20 | A-10 | THF | 2.34 | 534 | 7.2 |
| 11 | B-1 | A-20 | THF | 2.57 | 67 | 5.0 |
| 12 | B-1 | A-21 | THF | 2.45 | 545 | 6.5 |
| 13 | B-1 | A-22 | THF | 2.46 | 543 | 5.5 |
| 14 | B-1 | A-26 | THF | 2.25 | 590 | 7.96 |
| 15 | B-1 | A-27 | THF | 2.5 | 550 | 5.16 |
| 16 | B-1 | A-30 | THF | 2.7 | 578 | 9.2 |
| 17 | B-3 | A-28 | THF | 2.33 | 543 | 6.96 |
| 18 | B-3 | A-29 | THF | 2.32 | 553 | 6.05 |
| 19 | B-1 | A-26 | THF | 2.23 | 576 | 6.82 |

EXAMPLES 20–26

A number of inverted dual layer OPCs having CTLs were prepared by the procedure mentioned above in Examples 1–19.

The CGL was also prepared by the procedure described in Examples 1–19, except that 5 g of the following polymer was added as crosslinker:

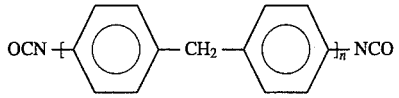

The CGL was baked at different temperatures. The results are illustrated in Table III:

TABLE III

CROSSLINKING CGL BY DIFFUSION COATING PROCESS

| EXAMPLE | CTL BINDER | CGL BINDER | CGL SOLVENT | CGL BAKING | OD | E1/5 (ergs/cm$^2$) | CROSSLINKING |
|---|---|---|---|---|---|---|---|
| 20 | B-1 | A-20 | THF | 80° C. | 2.50 | 8.95 | No |
| 21 | B-1 | A-20 | THF | 150° C., 10 min. | 2.57 | 3.57 | Yes |
| 22 | B-1 | A-21 | THF | 80° C. | 2.52 | 7.89 | No |
| 23 | B-1 | A-21 | THF | 135° C., 18 min. | 2.53 | 4.79 | Yes |
| 24 | B-1 | A-30 | THF | 80° C. | 2.70 | 12.0 | No |
| 25 | B-1 | A-30 | THF | 135° C., 30 min. | 2.73 | 6.50 | Yes |
| 26 | B-1 | A-27 | THF | 150° C., 5 min. | 2.55 | 5.0 | Yes |

Table III exhibits the effect of crosslinker on the crosslinking of CGL. The higher baking temperature indicates the crosslinking effect together with the annealing effect on the photoresponse. It appears that the annealing effect enhances the diffusion of CGL into CTL and thus, the photoresponse is higher.

The following Examples 27–29 show the annealing effect on diffusion even with non-crosslinking-type CGL binders.

EXAMPLES 27–29

Example 1, described above, was repeated, except that the CGL was baked at different temperatures. The results are illustrated in Table IV:

TABLE IV

EFFECT OF ANNEALING TEMPERATURE ON DIFFUSION PROCESS

| EXAMPLE | CTL BINDER | CGL BINDER | CGL BAKING | OD | E1/5 (ergs/cm$^2$) | CROSSLINKING |
|---|---|---|---|---|---|---|
| 1 | B-1 | A-1 | 80° C., 20 min. | 2.5 | 5.0 | No |
| 27 | B-1 | A-1 | 135° C., 10 min. | 2.5 5 | 3.5 | No |

TABLE IV-continued

| EFFECT OF ANNEALING TEMPERATURE ON DIFFUSION PROCESS | | | | | | |
|---|---|---|---|---|---|---|
| EXAMPLE | CTL BINDER | CGL BINDER | CGL BAKING | OD | E1/5 (ergs/cm$^2$) | CROSSLINKING |
| 28 | B-1 | A-30 | 80° C., 20 min. | 2.7 | 9.2 | No |
| 29 | B-1 | A-30 | 150° C., 5 min. | 2.7 7 | 4.5 | No |

It should be noted from Table IV that all of the samples which were baked at elevated temperatures (above 135° C.) were not crosslinked because no crosslinker was added. Therefore, the baking condition at elevated temperature (above 135° C.) was confirmed to enhance the diffusion of CGL deeper into CTL and thus, increased the OD as well as the photoresponse effect. The crosslinking test was carried out by the solubility test of the baked samples in THF.

EXAMPLES 30–39

Example 1 was repeated, except that the x-form phthalocyanine pigment was replaced with various photoconductive pigments (charge generation molecule, CGM). The non-chlorinated solvents were selected so that the optimal dispersion is achieved in each case. The results are shown in Table V:

TABLE V

| EFFECT OF DIFFERENT TYPES OF CGM | | | | | | |
|---|---|---|---|---|---|---|
| EXAMPLE | CGM | SOLVENT | BAKING CONDITION | OD | $V_o$ (V) | E1/5 (ergs/cm$^2$) |
| 30 | alpha-TiOPc | THF | 80° C. | 2.25 | 540 | 6.0 |
| 31 | alpha-TiOPc | THF | 135° C., 10 min. | 2.35 | 525 | 3.5 (at 830 nm) |
| 32 | Perylene (BASF, Paliogen Black) | MIBK | 135° C. 10 min. | 2.9 | 620 | 3.2 (at 630 nm) |
| 33 | CdS | THF | 135° C., 10 min. | 3.0 | 635 | 5.0 (at 520 nm) |
| 34 | ClInPc | THF | 235° C., 10 min. | 2.5 | 546 | 7.0 (at 820 nm) |
| 35 | BrInPc | THF | 135° C., 10 min. | 2.54 | 543 | 6.0 (at 790 nm) |
| 36 | Squarylium dye | THF | 135° C., 10 min. | 2.80 | 590 | 8.0 (at 780 nm) |
| 37 | Trisazo pigment | THF | 135° C., 10 min. | 2.8 | 600 | 6.0 (at 780 nm) |
| 38 | Bisazo pigment | THF | 135° C., 10 min. | 2.78 | 579 | 6.0 (at 630 nm) |
| 39 | dibromo anthanthrone pigment | THF | 135° C. 10 min. | 2.5 | 578 | 7.2 (at 520 nm) |

The structures for the pigments/dyes of Examples 36–38 are as follows:

EXAMPLE 36: SQUARYLIUM DYE

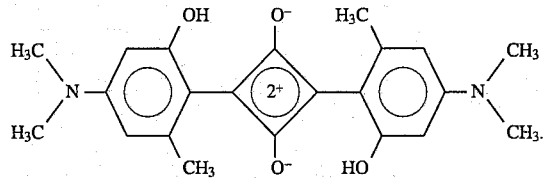

EXAMPLE 37: TRISAZO PIGMENT

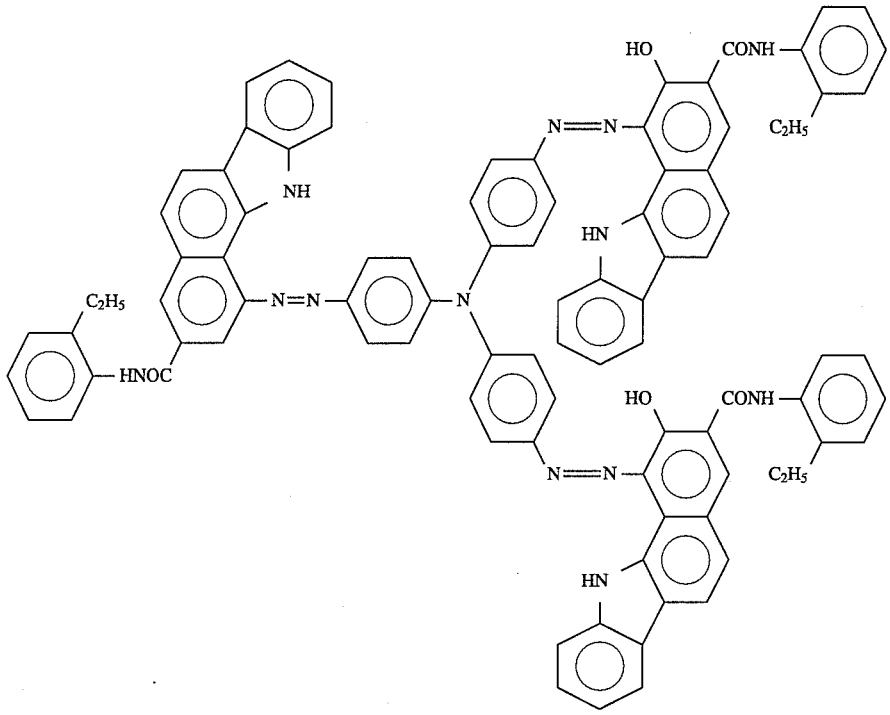

EXAMPLE 38: BISAZO PIGMENT

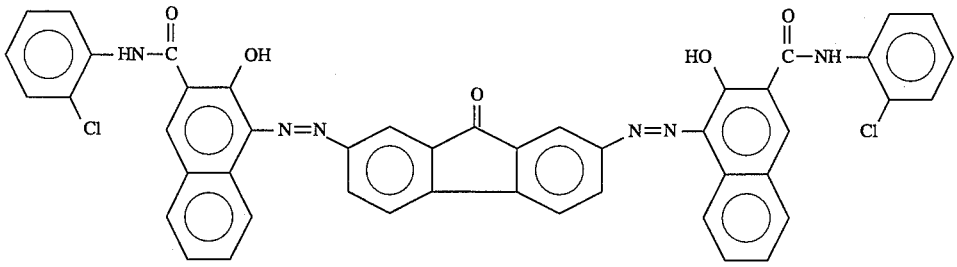

EXAMPLE 40

Figure 2:
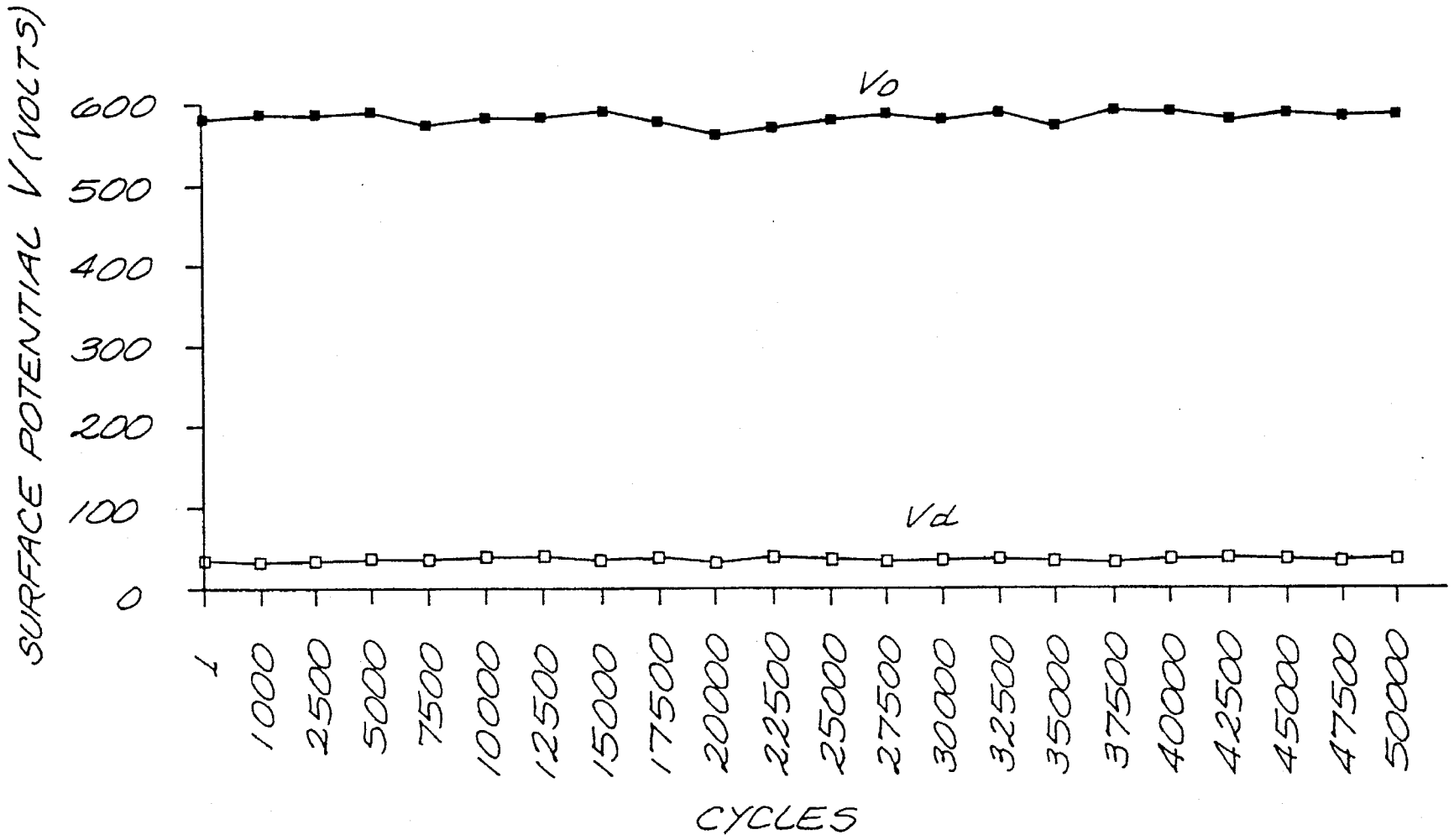
FIG. 2, on coordinates of surface potential V (Volts) and number of cycles, is a plot of life testing cycle for a photoconductor device employing the reusable inverse dual layer composite OPC of the present invention.

The photoconductor device prepared according to Example 1 was inserted into a prototype laser printer developed at Hewlett-Packard Company. The OPC drum was charged with corona discharge controlled by a grid voltage of +800 V and discharged by a laser diode synchronized at 780 nm with laser power of 0.25 mW off the optical system (polygon scanner/f-theta lens) and the drum rotation was set at 6 inches per second. The charge acceptance of the photoconductor was detected by an electrostatic charge probe Trek 342 (available from Trek Company) by two values $V_0$ (Volts) before laser exposure and $V_d$ (Volts) after laser exposure and at the developer station. The life testing cycle of charge →laser discharge→erase was repeated at room temperature and normal relative humidity for 100 thousand cycles. The result is illustrated in FIG. 2.

COMPARISON EXAMPLE 40A

The experiment described in Example 40 was repeated, but using the photoconductor sample described in Comparison Example 1D. The result is illustrated in FIG. 3, which illustrates the build-up of $V_d$ with time, thereby reducing $\Delta V$ ($V_0$–$V_d$), which relates to the contrast of the image.

COMPARISON EXAMPLE 40B

Comparison Example 1D was repeated, except that the hole transport molecule HT-1 was added to the CGL and adjusted to achieve the final composition described below:

| | |
|---|---|
| x-form metal-free phthalocyanine pigment | 5 wt % |
| HT-1 | 28 wt % |
| B-1 binder | 64 wt % |
| Solvent | THF |
| Solids (wt %) | 8% |
| CGL thickness | 10 μm. |

The photoconductor was exposed to the life cycle test described in Example 40 and the result is illustrated in FIG. 4. As with Comparison Example 40A, the contrast becomes smaller with time.

INDUSTRIAL APPLICABILITY

The inverse composite dual-layer organic photoconductor using the specific binders and non-chlorinated solvents for processing is expected to find use in electrophotographic printing, particularly in color electro-photographic printing. The crosslinking CGL of the improved dual layer of the invention is very useful for liquid toner development, as the crosslinking CGL is strongly inert to solvents. The inverted OPC of the present invention is reusable due to stable performance.

Thus, there has been disclosed an improved composite dual-layer organic photoconductor using specific binders and non-chlorinated solvents for processing. It will be readily apparent to those skilled in this art that various changes and modifications of an obvious nature may be made without departing from the scope of the invention, which is defined by the appended claims.

What is claimed is:

1. A method for fabricating; a reverse dual-layer organic photoconductor comprising a charge generation layer formed on top of a charge transport layer formed on top of a substrate, said charge generation layer comprising at least one charge generation molecular species selected from the group consisting of dyes and pigments and first binder molecules in a first composite matrix and said charge transport layer comprising at least one hole transport molecular species and second binder molecules in a second composite matrix, said first binder in said charge generation layer comprising at least one comparatively flexible thermoplastic or thermoset polymer having a glass transition temperature of less than about 120° C. in its thermoplastic state and said second binder in said charge transport layer comprising a polymer having at least one cycloalkyl group to provide said polymer with a glass transition temperature of greater than about 120° C., said method comprising:

(a) applying said charge transport layer to said substrate by (1) preparing a first solution of said at least one hole transport molecular species and second binder molecules in at least one non-chlorinated solvent, (2) coating said substrate with said first solution, and (3) evaporating said at least one non-chlorinated solvent to leave said charge transport layer on said substrate; and (b) applying said charge generation layer to said charge transport layer by (1) preparing a second solution of said charge generation molecular species and said first binder molecules in at least one non-chlorinated solvent, (2) coating said charge transport layer with said second solution, and (3) evaporating said at least one non-chlorinated solvent to (1) leave said charge generation layer on said charge transport layer and (2) form a clear diffused region between said charge generation layer and said charge transport layer, said clear diffused region having a thickness ranging from about 1 to 20% of that of said charge transport layer and providing said reverse dual-layer organic photoconductor with improved performance compared to reverse dual-layer organic. photoconductors having no diffused region or a hazy diffused region.

2. The method of claim 1 wherein said second binder polymer is selected from the group consisting of polycarbonates (V), polyesters (VI), polyimides (VII), vinyl polymers (VIII, IX), polysilane (X), and polygermane (XI):

(V)

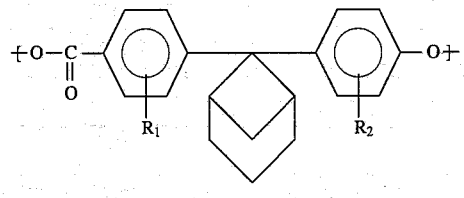

(VI)

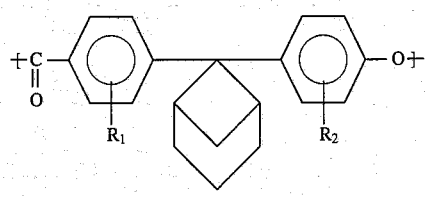

(VII)

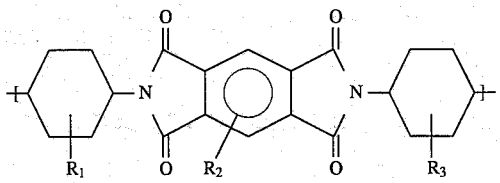

(VIII)

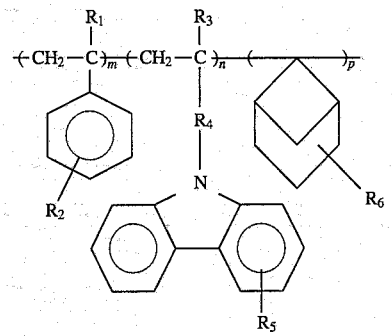

(IX)

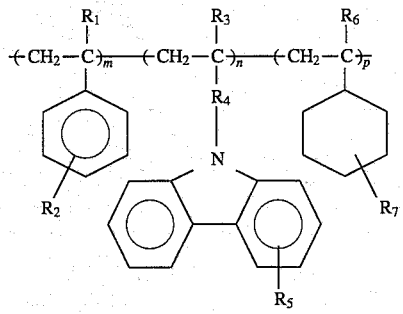

(X)

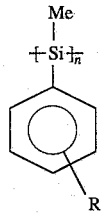

-continued (XI)

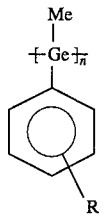

where R, $R_1$, $R_2$, $R_3$, $R_4$, $R_5$, $R_6$, and $R_7$ are independently selected from the group consisting of H, alkyl, cycloalkyl, alkenyl, alkoxy, aryl, and substituted groups, m, n, and p each range from 5 to 50, and m+n+p=100.

3. The method of claim 2 wherein said second binder molecules have a molecular weight ranging from about 10,000 to 3,000,000.

4. The method of claim 1 wherein said at least one charge generation molecular species is selected from the group consisting of:

(a) the metastable form of phthalocyanine pigments: x-form, tau-form of metal-free phthalocyanine pigment, alpha-, epsilon-, beta-form of copper phthalocyanine pigment, titanyl phthalocyanine pigments, vanadyl phthalocyanine pigment, magnesium phthalocyanine pigment, zinc phthalocyanine pigment, chloroindium phthalocyanine pigment, bromoindium phthalocyanine pigment, chloroaluminum phthalocyanine pigment, (b) pyrollo pyrole pigments;

(c) tetracarboximide perylene pigments;

(d) anthanthrone pigments;

(e) bis-azo, -trisazo, and -tetrakisazo pigments;

(f) zinc oxide pigment;

(g) cadmium sulfide pigment;

(h) hexagonal selenium;

(i) squarylium dyes; and (j) pyrilium dyes.

5. The method of claim 1 wherein said at least one hole transport molecular species is selected from the group consisting of triaryl methanes, triarylamines, hydrazones, pyrazolines, oxadiazoles, styryl derivatives, carbazolyl derivatives, and thiophene derivatives.

6. The method of claim 1 wherein said charge generation layer includes at least charge transport molecular species selected from the group consisting of hole transport molecular species and electron transport molecular species.

7. The method of claim 6 wherein said hole transport molecular species are selected from the group consisting of triaryl methanes, triarylamines, hydrazones, pyrazolines, oxadiazoles, styryl derivatives, carbazolyl derivatives, and thiophene derivatives and wherein said electron transport molecular species are selected from the group consisting of imino derivatives, sulfone derivatives, fluorenone derivatives, diphenoquinone derivatives, and styryl diphenoquinone derivatives.

8. The method of claim 1 wherein said at least one non-chlorinated solvent is selected from the group consisting of ketones, aromatic hydrocarbons, tetrahydrofuran, and alcohols.

9. The method of claim 8 wherein said at least one non-chlorinated solvent is selected from the group consisting of acetone, methyl ethyl ketone, methyl iso-butyl ketone, toluene, xylene, methanol, ethanol, and iso-propanol.

10. The method of claim 1 wherein said first and second solutions each comprise about 0.01 to 20 wt % solids and the balance said at least one non-chlorinated solvent.

11. The method of claim 1 wherein said coating is performed at a speed within the range of about 0.01 to 5 inch per second.

12. The method of claim 1 wherein said binder in said charge generation layer is present in a concentration ranging from about 30 to 99.99 wt %.

13. The method of claim 12 wherein said binder is present in a concentration ranging from about 50 to 98 wt %.

14. The method of claim 1 wherein said charge generation layer is formed to a thickness in the range of about 0.05 to 10 μm.

15. The method of claim 1 wherein said amount of penetration is controlled by a two-step drying process following coating said charge generation layer on said charge transport layer:

(a) slow-drying said non-chlorinated solvent at an elevated temperature at or below its boiling point; and (b) annealing said coated charge transport layer at a temperature of at least about 120° C.

16. The method of claim 15 wherein said slow-drying is carried out at a temperature in the range of about 60° to 100° C. for at least about 10 minutes and wherein said annealing is carried out at a temperature in the range of about 120° to 150° C. for at least about 10 minutes.

17. The method of claim 15 wherein a crosslinker aid is added to said first solution prior to coating said charge generation layer on said charge transport layer to convert said polymer from a thermoplastic polymer to a thermoset polymer during said two-step drying process.

18. The method of claim 17 wherein said crosslinker aid is selected from the group consisting of polydiisocyanate, phenolic resins, melamine resins, epoxy, dialdehydes, anhydrides, and diols.

19. The method of claim 1 wherein said charge transport layer is formed to a thickness in the range of about 5 to 50 μm.

20. The method of claim 1 wherein said first binder polymer is selected from the group consisting of the following vinyl polymers (I, II, III) and poly dimethyl siloxane (IV):

(I)

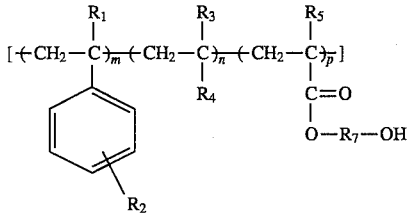

(II)

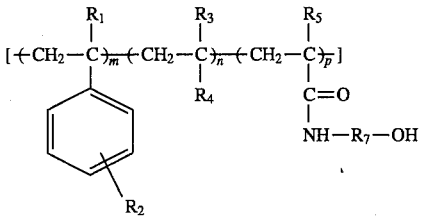

-continued

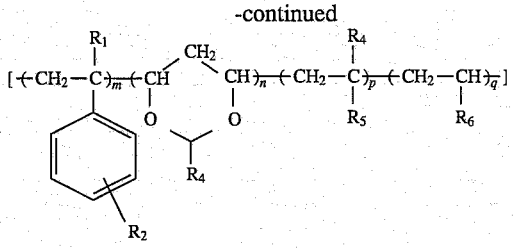

(III)

where $R_1$, $R_2$, $R_3$, $R_4$, $R_5$, and $R_6$ are independently selected from the group consisting of H, alkyl, cycloalkyl, alkenyl, alkoxy, aryl, and substituted groups, $R_7$ is selected from the group consisting of alkyl, cycloalkyl, alkenyl, alkoxy, aryl, and substituted groups, m ranges from 0 to 100, n, p, and q each range from 0 to 50, m+n+p=100, and m+n+p+q=100; and

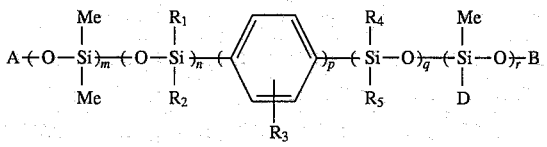

(IV)

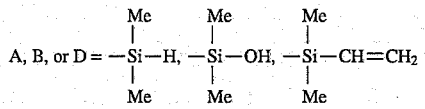

-continued

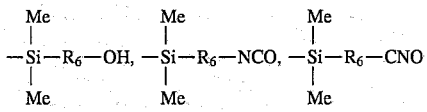

where $R_1$, $R_2$, $R_3$, $R_4$, $R_5$, and $R_6$ are independently selected from the group consisting of alkyl, substituted alkyl, aryl, and substituted aryl groups, m, n, q, and r each range from 10 to 100, p ranges from 0 to 50, and m+n+p+q+r=100.

21. The method of claim 20 wherein said first binder molecules have a molecular weight ranging from about 30,000 to 3,000,000.

22. The method of claim 21 wherein said first binder molecules have a molecular weight ranging from about 800,000 to 1,000,000.

23. The method of claim 19 wherein said charge transport layer has a thickness ranging from about 10 to 20 μm.

* * * * *